US008122859B2

(12) United States Patent
Phelps et al.

(10) Patent No.: US 8,122,859 B2
(45) Date of Patent: Feb. 28, 2012

(54) NYLON BODY LOCATED PISTON COOLING NOZZLE

(75) Inventors: Neal R. Phelps, Bargersville, IN (US); Stephen D. Cofer, Jr., Sugar Grove, PA (US); Kent H. Clark, Panama, NY (US); Eric D. Stahl, Columbus, IN (US); Kenneth Howard, Indianapolis, IN (US); John Cook, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 587 days.

(21) Appl. No.: 12/255,992

(22) Filed: Oct. 22, 2008

(65) Prior Publication Data

US 2010/0095910 A1 Apr. 22, 2010

(51) Int. Cl.
*F01P 1/04* (2006.01)

(52) U.S. Cl. ..... 123/41.35; 310/54; 239/600

(58) Field of Classification Search ..... 123/41.17, 123/41.31, 41.34–41.37, 41.38, 41.39, 196 AB, 123/196 S, 196 R; 310/54, 52
See application file for complete search history.

(56) References Cited

U.S. PATENT DOCUMENTS

| | | | | |
|---|---|---|---|---|
| 4,204,487 | A * | 5/1980 | Jones | 123/41.35 |
| 4,508,065 | A * | 4/1985 | Suchdev | 123/41.35 |
| 4,901,679 | A | 2/1990 | Hodgkins et al. | |
| 4,979,473 | A * | 12/1990 | Lee | 123/41.35 |
| 5,649,505 | A | 7/1997 | Tussing et al. | |
| 6,237,548 | B1 * | 5/2001 | Chimonides | 123/41.35 |
| 6,298,810 | B1 * | 10/2001 | Chimonides et al. | 123/41.35 |
| 6,672,261 | B1 * | 1/2004 | Svensson | 123/41.35 |
| 6,832,437 | B2 | 12/2004 | Svensson | |
| 7,063,049 | B2 | 6/2006 | Kemp et al. | |
| 7,086,354 | B2 | 8/2006 | Dunbar et al. | |
| 7,240,643 | B1 * | 7/2007 | Perr et al. | 123/41.35 |
| 2004/0040520 | A1 * | 3/2004 | Bontaz et al. | 123/41.35 |
| 2010/0001103 | A1 * | 1/2010 | Neto et al. | 239/583 |

* cited by examiner

*Primary Examiner* — Michael Cuff
*Assistant Examiner* — Hung Q Nguyen
(74) *Attorney, Agent, or Firm* — Studebaker & Brackett PC; Tim L. Brackett, Jr.

(57) ABSTRACT

A piston cooling nozzle including a nylon body having a hub and a pair of integral legs extending from the hub and a tube for delivering coolant to a piston. The pair of legs are formed relative to the hub and the tube to ensure that when the body is mounted to an engine block, the legs engage a cylinder liner to thereby position the tube between a skirt of the piston and a connecting rod coupled to the piston.

17 Claims, 8 Drawing Sheets

NYLON BODY LOCATED PISTON COOLING NOZZLE

FIELD OF THE DISCLOSURE

The present invention generally relates to piston cooling nozzles and more particularly to a piston cooling nozzle having nylon body which includes abutment surfaces for positioning the nozzle relative to the piston and connecting rod by engaging the cylinder liner.

BACKGROUND OF THE DISCLOSURE

Piston cooling nozzles (PCNs) are known. In general, PCNs deliver oil to the pistons of an internal combustion engine to transfer heat away from the pistons. During operation, some of the heat resulting from fuel combustion is absorbed by the pistons, causing an undesirable temperature rise. Without adequate heat transfer away from the pistons, the carbon deposits may be increased on the pistons. One way to reduce this excess heat is through use of PCNs.

A PCN generally has an inlet which receives relatively cool oil from the engine's oil distribution system and an outlet which directs the cooled oil toward the piston associated with the PCN. The cool oil contacts surfaces of the piston to transfer heat away from the piston.

Delivery of the cooled oil to the desired locations on the piston is a performance specification taken into consideration during the design of the PCN. Not only is it desirable to deliver the oil to the surfaces of the piston yielding efficient heat transfer, it is more fundamentally desirable to avoid contact between the PCN and the piston or other moving parts. In certain engine designs, it has been observed that the connecting rod coupled to the piston contacts the tube portion (further described below) of the PCN during engine operation. Of course, repeated contact during the cyclical operation of the connecting rod leads to wear of the tube portion. This wear may manifest itself as a thin wall in a section of the tube portion (i.e., a flat spot on the outer diameter of the tube portion), or even a hole through the tube portion side wall, seriously impairing the PCN's ability to deliver oil to the piston as desired. In fact, the wear may ultimately lead to bending or breaking of the PCN, which may result in catastrophic engine failure.

As the discussion above indicates, precise mounting of the PCN is desirable to permit proper operation and avoid interference with the moving components of the engine. To date, PCN orientation is determined by either a machined locating feature on the engine block or a special interface formed on the block during casting. While machined locating features may permit very precise mounting of the PCNs, the design of some engine blocks makes machining a locating feature difficult to accomplish or otherwise undesirable. On the other hand, since a casting process is not as accurate as a machining process, the orientation of the PCN based on a cast feature of the block can vary somewhat relative to its preferred position due to surface inconsistencies and the relatively loose tolerances of the cast block.

One approach to improving the mounting accuracy of PNCs on cast engine blocks is described in U.S. Pat. No. 7,240,643, which is assigned to the present applicant. The approach described in the '643 patent includes brazing a metal tab or bracket to the tube portion of the PCN which functions as a spacer that is indexed off of the bottom end of the corresponding cylinder liner. While this approach is desirable for a variety of reasons set forth in the patent, an alternative PCN configuration may be better suited for certain engine designs.

SUMMARY OF THE DISCLOSURE

The present disclosure provides a PCN formed from nylon with legs that ensure the tube is precisely located relative to the piston by referencing off of the machined outer diameter of the corresponding cylinder liner. In various embodiments of the present disclosure, the legs may include projections that engage the liner to facilitate installation of the PCN. Additionally, the PCN may include an installation feature that releasably couples to an installation tool to permit a technician to guide the PCN into position during installation.

BRIEF DESCRIPTION OF THE DRAWINGS

The above-mentioned and other features of this invention and the manner of obtaining them will become more apparent and the invention itself will be better understood by reference to the following description of embodiments of the present invention taken in conjunction with the accompanying drawings.

Figure 1:
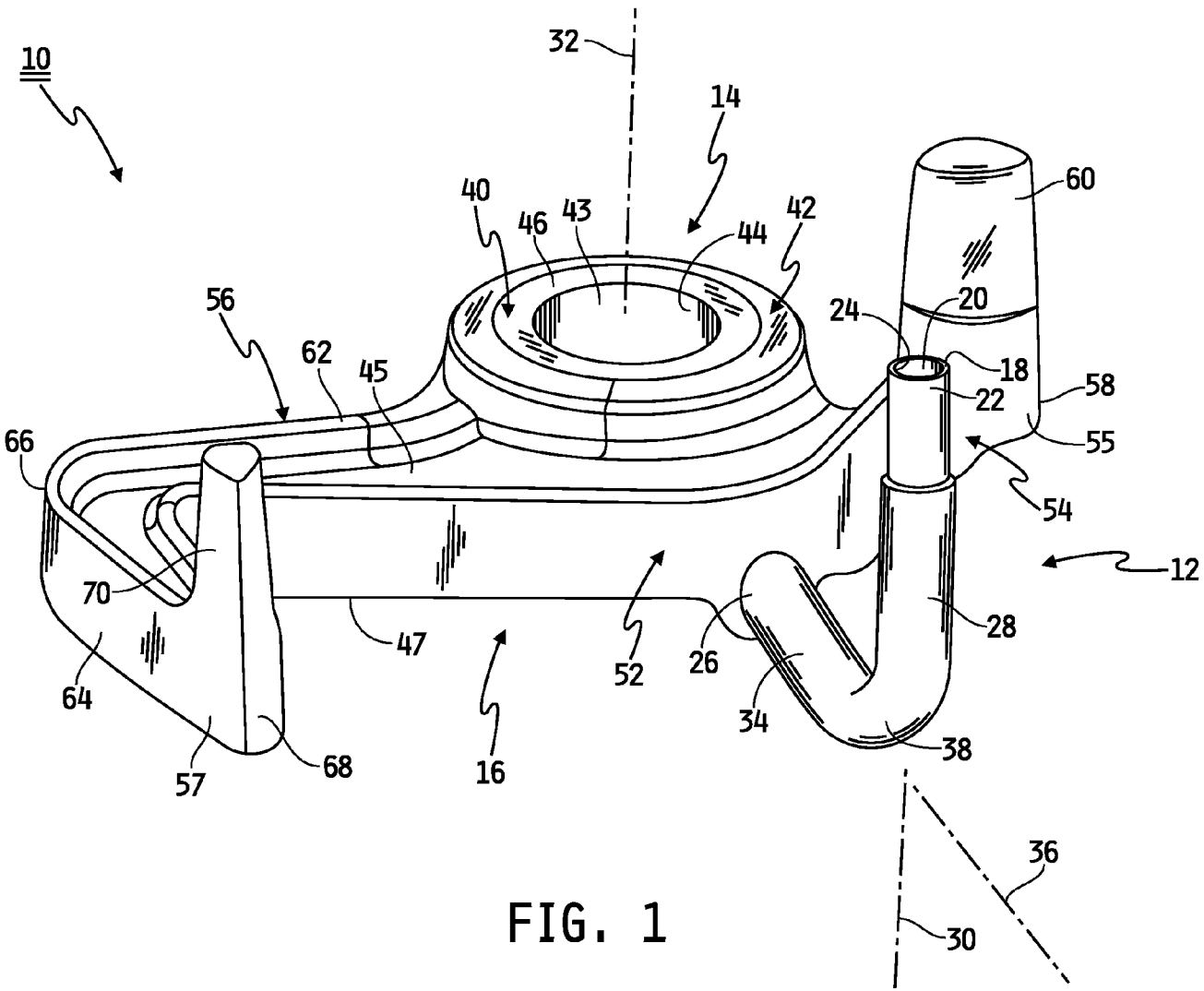
FIGS. 1 and 2 are perspective views of a PCN according to one embodiment of the present disclosure.

Although the drawings represent embodiments of various features and components according to the present invention the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE DISCLOSURE

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated device and described method and further applications of the principles of the invention, which would normally occur to one skilled in the art to which the invention relates. Moreover, the embodiments were selected for description to enable one of ordinary skill in the art to practice the invention.

Figure 2:
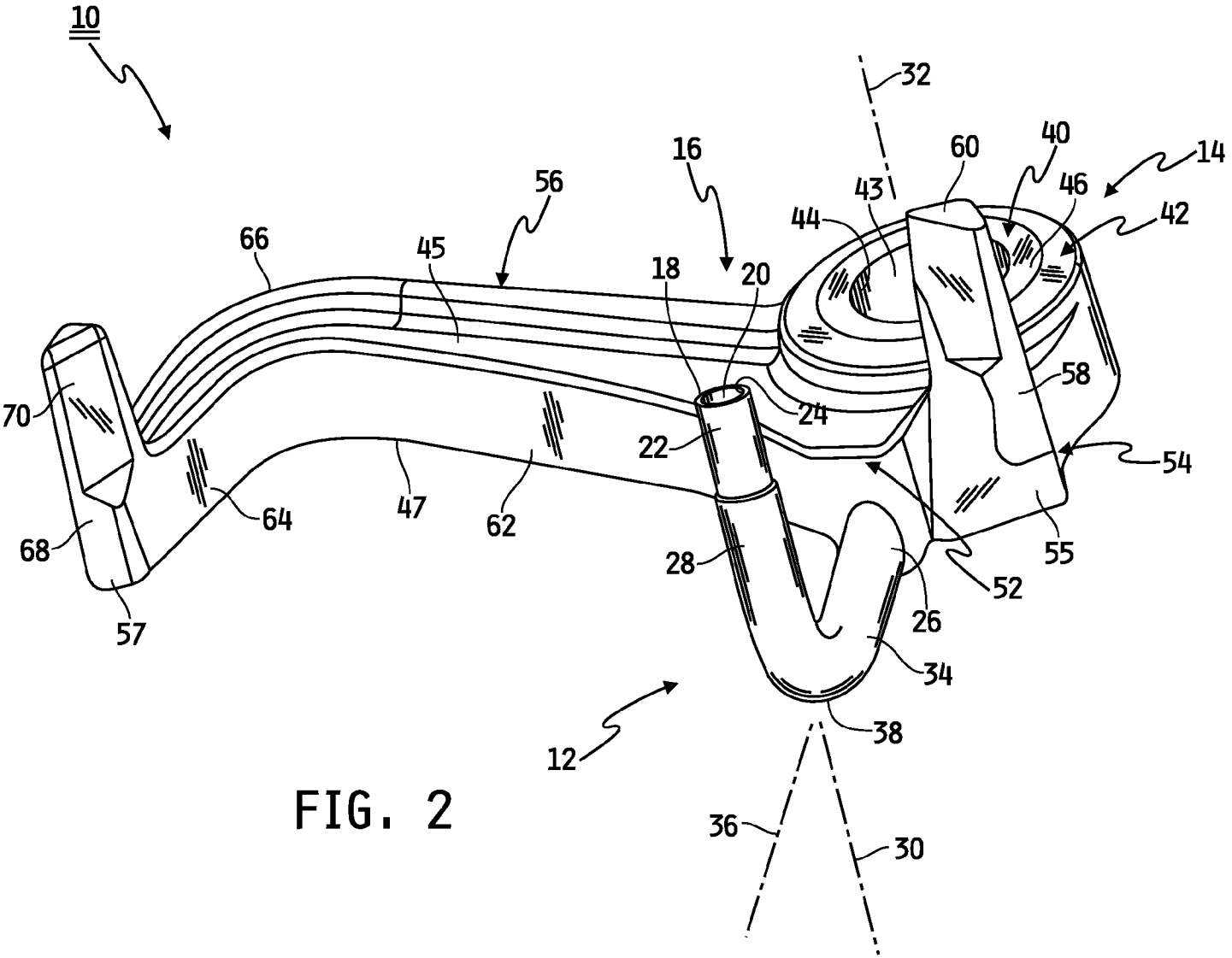
Figure 3:
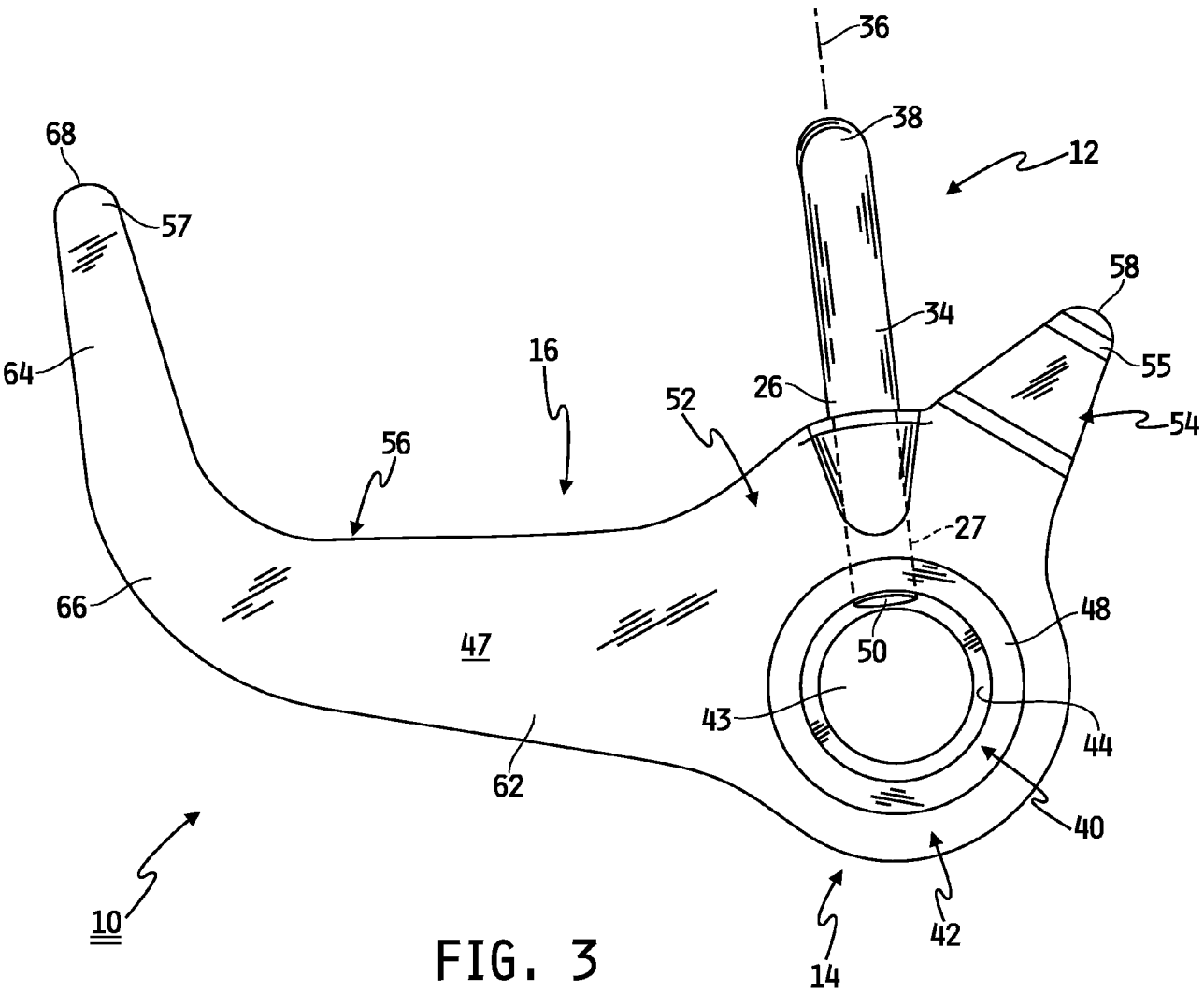
FIG. 3 is a plan view of a PCN according to one embodiment of the present disclosure.

FIGS. 1 through 3 depict a piston cooling nozzle (PCN) according to one embodiment of the present disclosure for use with a reciprocating engine. PCN 10 generally includes a tube 12 configured to direct cooling oil toward a corresponding piston, a hub 14 configured for mounting PCN 10 to the engine and directing a supply of oil to tube 12 as further described below, and a body 16 (formed of a synthetic polymer such as the nylon family of polymers or other suitable material) configured to permit accurate location of tube 12.

As shown, tube 12 includes a side wall 18, an interior bore 20, a first end 22 forming an outlet 24, and a second end 26 connected to body 16. Second end 26 also forms an opening (not shown) which is in flow communication with an oil passage 27 (FIG. 3) formed through body 16 from hub 14 to the location of connection of second end 26 of tube 12. Tube 12 includes a first portion 28 having a longitudinal axis 30 which is substantially parallel to a central axis 32 of hub 14. Tube 12 further includes a second portion 34 having a longitudinal axis 36 which is substantially perpendicular to central axis 32 of hub 14. First portion 28 and second portion 34 are joined at an elbow 38. As should be apparent from the foregoing, interior bore 20 of tube 12 extends from outlet 24, through first portion 28, elbow 38, and second portion 34 to convey cooling oil from oil passage 27 in body 16 to outlet 24.

Hub 14 includes a substantially cylindrical insert 40 formed of, for example, steel, which is mounted in a substantially cylindrical portion 42 of body 16 using any of a variety of suitable mechanical bonding techniques. Insert 40 forms a central opening 43 and includes a side wall 44, an upper end 46, and a lower end 48 (FIG. 3). Side wall 44 includes an opening 50 (FIG. 3) aligned with oil passage 27.

Body 16 includes a first side 45, a second side 47, a central portion 52 including hub 14 and to which tube 12 is mounted, a first leg 54 extending from central portion 52, and a second leg 56 extending from central portion 52. First leg 54 projects substantially radially outwardly from hub 14 and includes an outer abutment surface 58 at its distal end 55. In the embodiment shown, first leg 54 further includes a first projection 60 which extends from first leg 54 in a direction substantially parallel to central axis 32 of hub 14. As is further explained below, first projection 60 is optional, and used in certain assembly processes for installation of PCN 10. Second leg 56 includes an inner portion 62 which also projects substantially radially outwardly from hub 14. Second leg 56 further includes an outer portion 64 connected to inner portion 62 at an elbow 66. Outer portion 64 of second leg 56 includes an abutment surface 68 at its distal end 57. Second leg 56 is shown in the figures as including an optional second projection 70 which extends from outer portion 64 of second leg 56 in a direction substantially parallel to central axis 32 of hub 14. Like first projection 60, second projection 70 may be used during installation of PCN 10 as further described below. Both first projection 60 and second projection 70 extend away from first side 45 of body 16 substantially parallel to first portion 28 of tube 12.

Referring now to FIGS. 4 through 7, PCN 10 is shown mounted to an engine block (not shown) in its operational orientation. PCN 10 is mounted to the engine block using a banjo bolt 72 (or other suitable flow-through fastener) having a threaded shaft 74 with a central bore 75 (FIG. 5), a head 78, and a reduced diameter central section (not shown). As shown, banjo bolt 72 extends through hub 14. As is known in the art, banjo bolt 72 is threaded into a corresponding opening formed in the engine block to which is supplied pressurized cooling oil. As threaded shaft 74 is tightened into the threaded opening of the engine block, head 78, which has a diameter that is larger than central opening 43 of hub insert 40, of banjo bolt 72 captures body 16 of PCN 10 against the engine block. Not only does banjo bolt 72 secure PCN 10 to the engine block, banjo bolt 72 communicates oil from the engine block to tube 12. More specifically, the reduced diameter central section of banjo bolt 72 includes a through hole which extends into central bore 75. Oil flows from the opening formed in the engine block, through (1) central bore 75, (2) the through hole in the reduced diameter section of banjo bolt 72, (3) opening 50 of insert 44, (4) oil passage 27 of body 16, and (5) tube 12.

Figure 4:
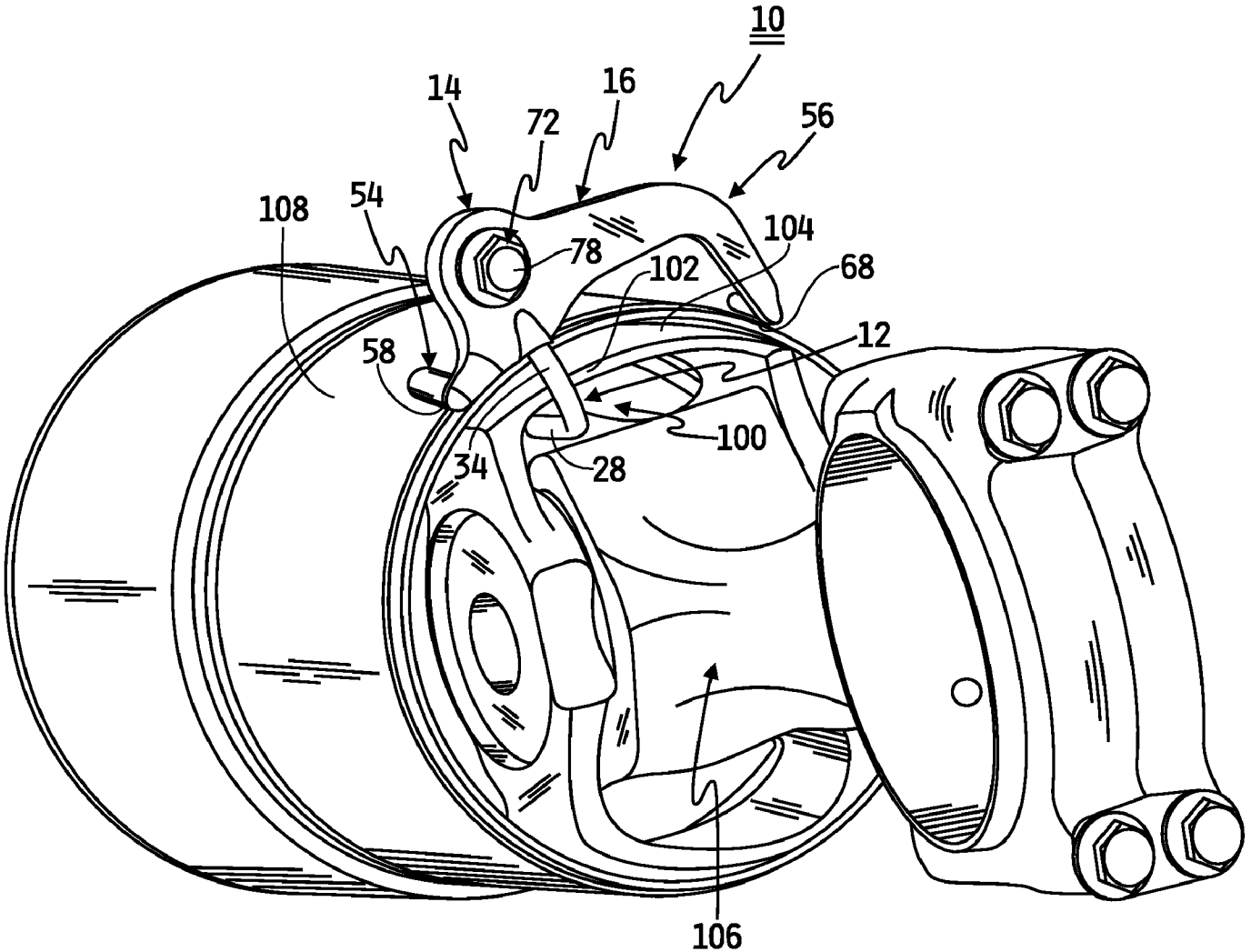
FIG. 4 is a perspective view of the PCN of FIGS. 1 through 3 shown in a mounted orientation.
Figure 5:
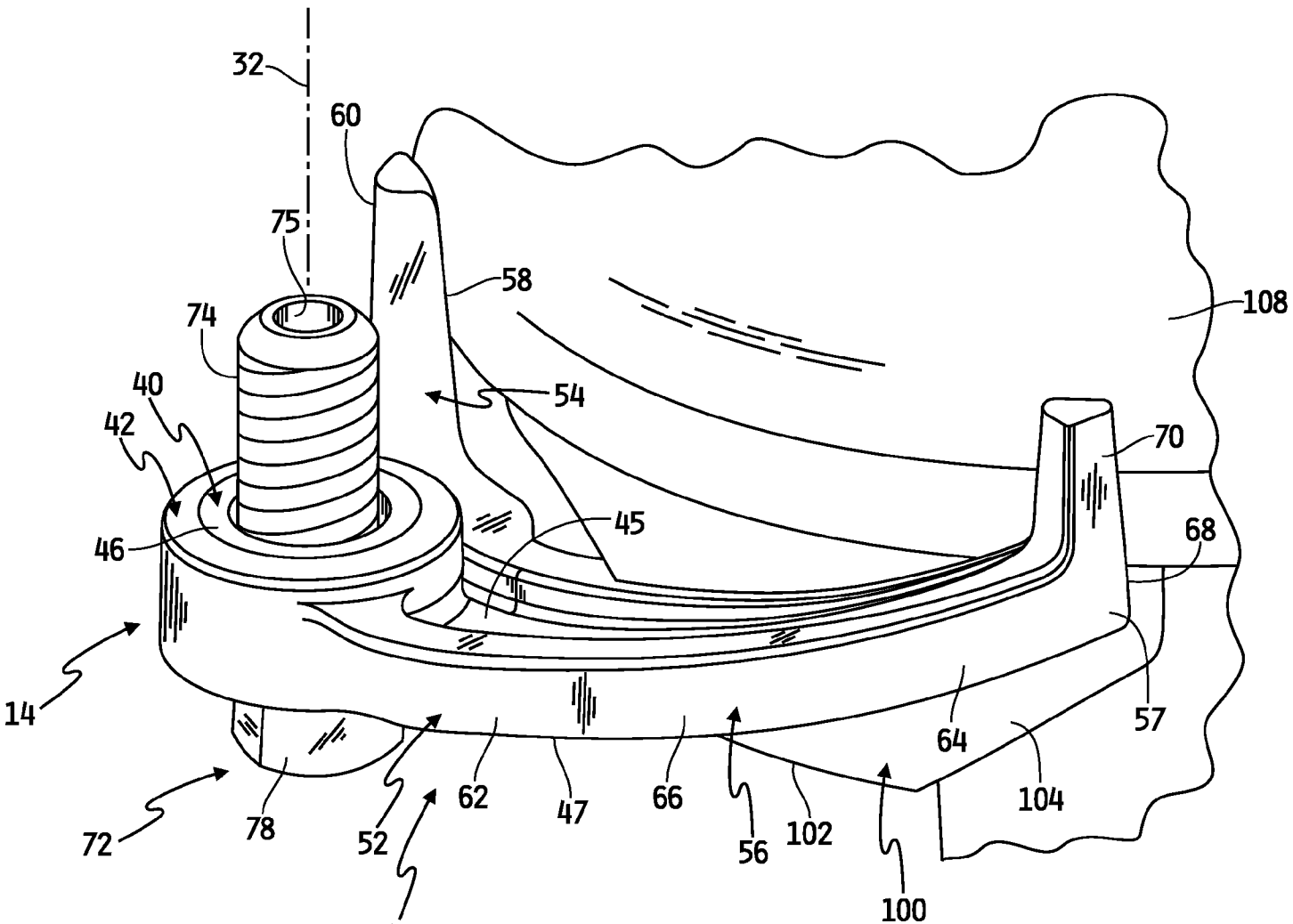
FIGS. 5 and 6 are partially fragmented, perspective views of the PCN of FIGS. 1 through 3 shown in a mounted orientation.
Figure 6:
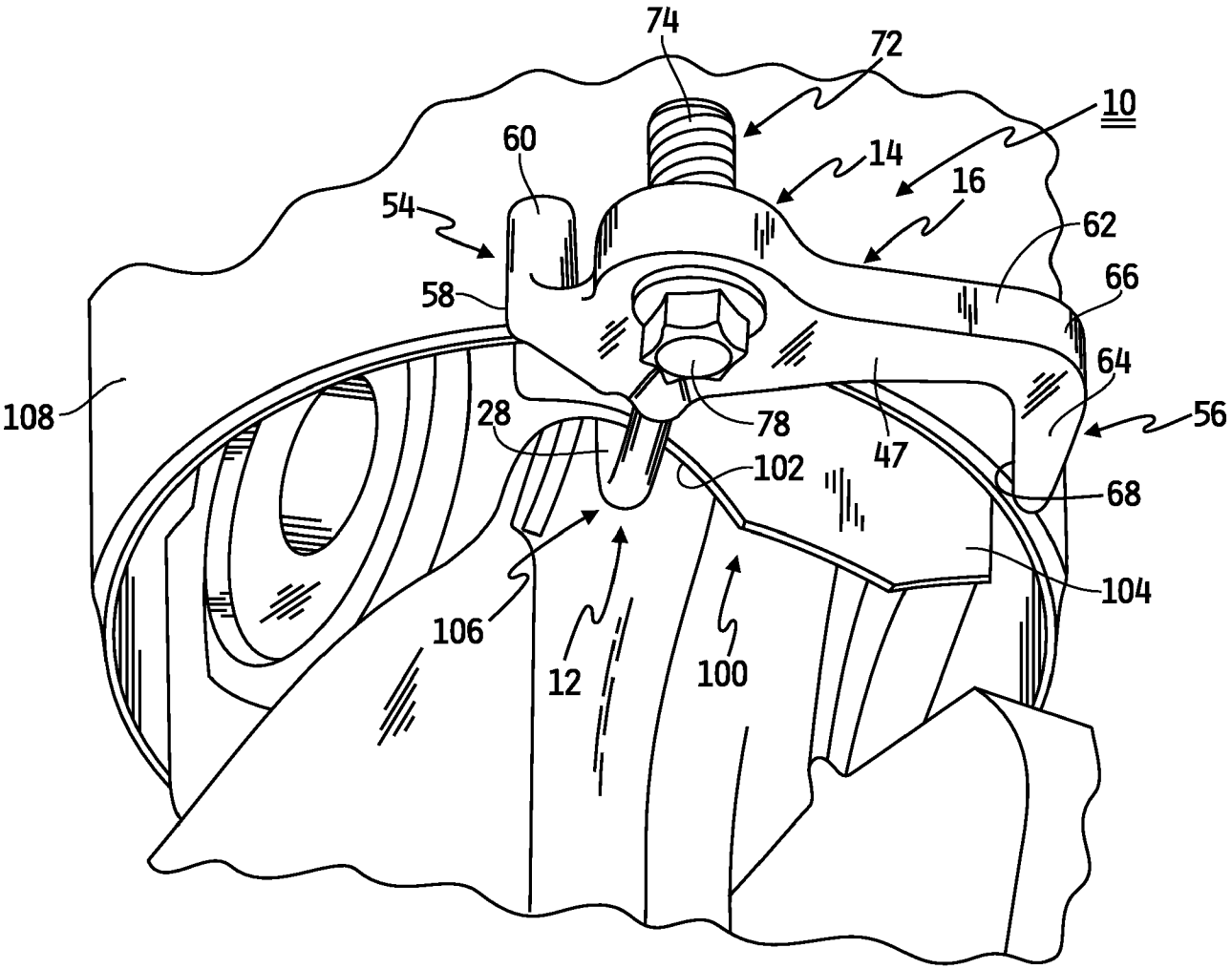
Figure 7:
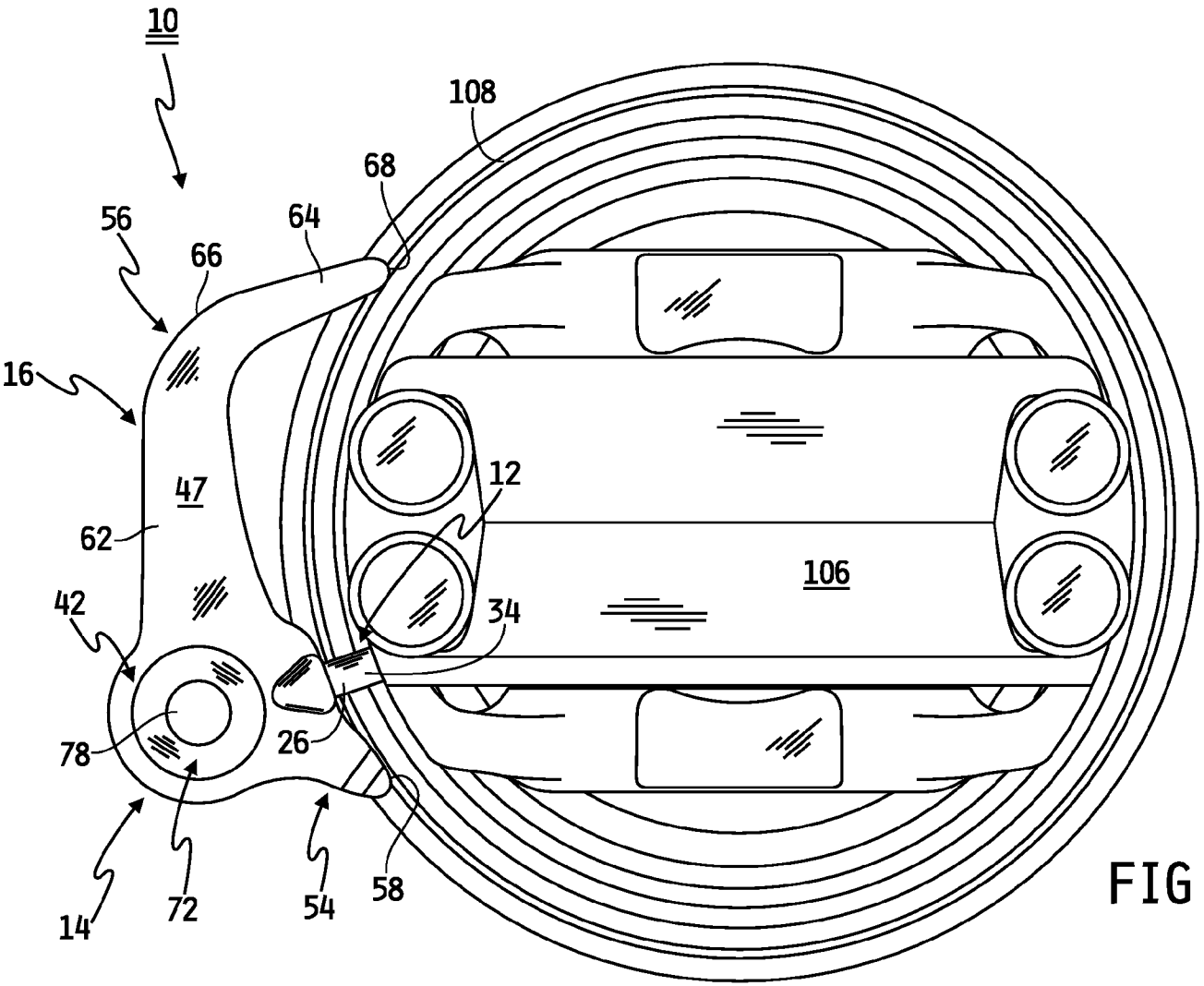
FIG. 7 is a plan view of the PCN of FIGS. 1 through 3 shown in a mounted orientation.

When PCN 10 is mounted to the engine block, tube 12 extends into the interior of the corresponding piston 100. As best shown in FIGS. 4 and 6, even when piston 100 is in the bottom dead center position as shown, the lower edge 102 of the piston skirt 104 does not contact tube 12. Moreover, tube 12 is spaced between piston skirt 104 and connecting rod 106 such that during operation of the engine, neither piston skirt 104 nor connecting rod 106 will contact tube 12. Tube 12 is accurately positioned in this orientation and maintained in location by body 16 of PCN 10. More specifically, abutment surfaces 58 and 68 of first leg 54 and second leg 56, respectively, engage the side wall of cylinder liner 108 as shown in the figures. The dimensions of liner 108 and its orientation relative to the banjo bolt opening formed in the engine block are tightly controlled during production. Accordingly, abutment surfaces 58, 68 may be formed relative to central axis 32 of hub 14 such that when PCN 10 is mounted to the engine block, first portion 28 of tube 12 is positioned safely between piston skirt 104 and connecting rod 106. The interference between first arm 54 and second arm 56 with cylinder liner 108 prevents PCN 10 (and therefore, tube 12) from rotating about central axis 32 out of the desired position. By forming abutment surfaces 58, 68 on body 16, alignment of tube 12 may be ensured without additional processing steps such as attaching an alignment feature to body 16 after body 16 is formed. In an alternative embodiment of the present disclosure, only one of first leg 54 or second leg 56 are formed on body 16 and used to position tube 12 in the manner described above.

It should further be understood that abutment surfaces 58, 68 may extend onto projections 60, 70, respectively, such that projections 60, 70 engage the outer diameter of cylinder liner 108 when PCN 10 is mounted to the engine. For example, in some assembly lines, the engine block is on its side when PCN 10 is installed such that PCN 10 could rotate out of position when banjo bolt 72 begins to engage the corresponding threaded opening in the engine block. By forming PCN 10 with projections 60, 70, as soon as banjo bolt 72 engages the block, abutment surfaces 58, 68 formed on projections 60, 70, respectively, engage cylinder liner 108 to maintain PCN 10 in the desired position.

Figure 8:
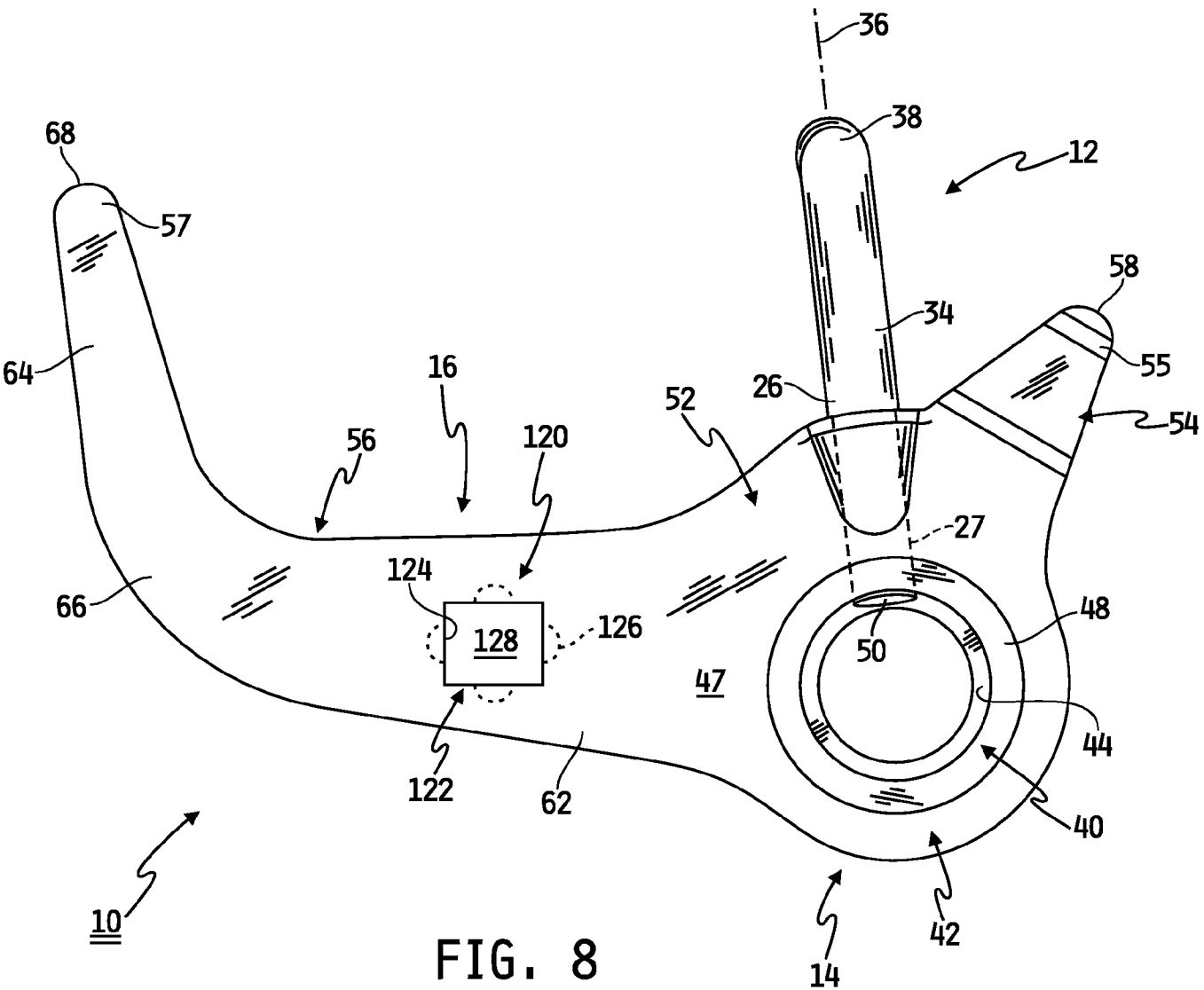
FIG. 8 is a plan view of a PCN according to another embodiment of the present disclosure.

In another embodiment of the invention depicted in FIG. 8, an installation feature 120 is formed on body 16. It should be understood that installation feature 120 may be formed on PCN 10' in addition to the alignment feature provided by first leg 54 and second leg 56, or may be included on other PCN designs that do not incorporate an alignment feature. On some engines, very little space is available around the connecting rods to permit installation of PCNs. The installation technician must hold the PCN and banjo bolt 72 while moving the assembly into position, then fasten banjo bolt 72 to mount the PCN. Generally, the technician holds the assembly with his hands or with the aid of pliers or vice grips. The limited clearance in the area, however, increases the difficulty of installation on certain engines.

Installation feature 120, in one embodiment, includes a substantially cubical recess 122 formed into second side 47 of body 16 on inner portion 62 of second leg 56. As shown, recess 122 includes four side walls 124, each having a detent 126 formed therein. Recess 122 further includes a lower wall 128. Detents 126 are sized and positioned relative to side walls 124 and lower wall 128 to receive the spring loaded balls of a standard sized drive extension for a ratchet wrench. Most drive extensions include an elongated rod or shaft configured on one end to connect to a wrench and outfitted on the other end with one or more captive balls that are spring biased outwardly through corresponding openings formed in the end of the rod. In the same manner that sockets may be attached to the end of such a drive extension, body 16 of PCN 10' may be attached to the drive extension. As the drive extension is inserted into recess 122, one or more of the spring loaded balls of the extension are urged inwardly against the biasing spring by side walls 124. When the drive extension is fully inserted into recess 122, the spring loaded ball(s) register with detent(s) 126 and move outwardly under the force of the biasing spring into detent(s) 126. The releasable connection force provided by the biasing spring and mated ball(s)/detent(s) is sufficient to permit the installation technician to guide PCN 10' into position by holding the drive extension. After PCN 10' is positioned and mounted to the engine block using banjo bolt 72, the drive extension may simply be pulled out of recess 122 with minimal force.

It should be understood that variations of installation feature 120 may include other attachment and release configurations. For example, a projection may be formed on body 16 with a movable engagement component (i.e., similar to the balls of the drive extension) and the guiding tool may include a recess with detents to receive the movable engagement component. Alternatively, the guiding tool and installation feature 120 may be loosely threaded to maintain engagement during installation, but permit easy removal of the guiding tool after mounting of PCN 10'. Other variations may be employed by one skilled in the art consistent with the teachings of the present disclosure.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An engine, including:

an engine block;

a cylinder liner mounted on the engine block and including an inner diameter surface, a bottom surface, and outer diameter surface;

a piston positioned in said cylinder liner;

a piston cooling nozzle coupled with the engine block and including a body including an integral first leg, and a hub formed on the body and configured to receive a fastener to mount the body to an engine block, the hub including an opening for receiving a supply of oil, the opening being in flow communication with a passage extending through the body, said piston cooling nozzle further including a tube coupled to the body and having an interior bore which is in flow communication with the passage for receiving the oil, the tube further including an opening for directing the oil toward a piston;

wherein the first leg of the body includes a first abutment surface spaced from the hub, said inner diameter surface, and said bottom surface, the first abutment surface positioned in abutment against said outer diameter surface of said liner and free from contact with said inner diameter surface and said bottom surface to position the tube in a desired location relative to the piston.

2. The nozzle of claim 1, wherein the first leg extends substantially radially outwardly from the hub.

3. The nozzle of claim 1, wherein the first abutment surface is formed on a distal end of the first leg.

4. The nozzle of claim 1, wherein the hub includes a cylindrical insert, the hub opening being formed through the insert.

5. The nozzle of claim 1, wherein the body further includes an integral second leg having a second abutment surface spaced from the hub such that when the nozzle is mounted to the engine block, the second abutment surface engages the liner to position the tube.

6. The nozzle of claim 5, wherein the second leg includes an inner portion that extends substantially radially outwardly from the hub and an outer portion that is coupled to the inner portion by an elbow.

7. The nozzle of claim 5, wherein the second abutment surface is formed on a distal end of the second leg.

8. The nozzle of claim 5, wherein the first leg includes a first projection that extends away from a first side of the body substantially parallel to a central axis through the hub, the first abutment surface being located on the first projection.

9. The nozzle of claim 8, wherein the second leg includes a second projection that extends away from the first side of the body substantially parallel to the central axis through the hub, the second abutment surface being located on the second projection.

10. The nozzle of claim 1, wherein the body further includes an installation feature including a first surface formed on the body configured to releasably couple with a second surface formed on an installation tool to facilitate installation of the nozzle.

11. The nozzle of claim 1, wherein the body further includes a substantially cubical recess having a side wall with a detent formed therein, the recess being configured to receive a drive extension to couple the body to the drive extension during installation of the nozzle.

12. An engine, including:

an engine block;

a cylinder liner mounted on the engine block and including an inner diameter surface, a bottom surface, and outer diameter surface;

a piston positioned in said cylinder liner;

a piston cooling nozzle coupled with the engine block and including a body having a hub, a pair of legs extending from the hub, and a tube to deliver coolant to the piston, the tube including a first portion having an opening for delivering the coolant and a second portion coupled to the body to receive the coolant from the hub;

wherein the pair of legs are formed relative to the position of the hub and the position of the first portion of the tube to ensure that when the body is mounted to an engine block, the legs positioned in abutment against said outer diameter surface of said liner and free from contact with said inner diameter surface and said bottom surface to thereby position the first portion of the tube between a skirt of the piston and a connecting rod coupled to the piston.

13. The nozzle of claim 12, wherein the legs extend substantially radially outwardly from the hub.

14. The nozzle of claim 12, wherein each leg includes a respective abutment surface formed on a distal end of the leg.

15. The nozzle of claim 12, wherein one of the legs includes an inner portion that extends substantially radially outwardly from the hub and an outer portion that is coupled to the inner portion by an elbow.

16. The nozzle of claim 12, wherein each leg includes a respective projection that extends away from a first side of the body substantially parallel to a central axis through the hub such that the projections of the legs engage the liner when the nozzle is mounted to the engine block.

17. The nozzle of claim 12, wherein the body further includes an installation feature including a first surface formed on the body configured to releasably couple with a second surface formed on an installation tool to facilitate installation of the nozzle.

* * * * *